United States Patent [19]

Araki et al.

[11] Patent Number: 4,805,666

[45] Date of Patent: Feb. 21, 1989

[54] SLIDE VALVE

[75] Inventors: Tokinori Araki, Higashiosaka; Masaharu Asada, Ayama, both of Japan

[73] Assignee: Matsushita Refrigeration Company, Higashiosaka, Japan

[21] Appl. No.: 63,830

[22] Filed: Jun. 19, 1987

[30] Foreign Application Priority Data

Feb. 20, 1987 [JP] Japan ..... 62-38489

[51] Int. Cl.[4] ..... F16K 31/06; F16K 11/00

[52] U.S. Cl. ..... 137/625.43; 251/65; 137/596.17; 137/599.1

[58] Field of Search ..... 137/625.43, 596.17, 137/599.1; 251/65

[56] References Cited

U.S. PATENT DOCUMENTS

| | | |
|---|---|---|
| 2,976,701 | 3/1961 | Greenawalt . |
| 3,329,168 | 7/1967 | Vollmer . |
| 3,678,959 | 7/1972 | Liposky . |
| 4,027,700 | 6/1977 | Perkins . |
| 4,255,939 | 3/1981 | Ou . |
| 4,403,765 | 9/1983 | Fisher ..... 251/65 |

FOREIGN PATENT DOCUMENTS

| | | |
|---|---|---|
| 253318 | 7/1964 | Australia . |
| 276798 | 7/1967 | Australia . |
| 606620 | 8/1948 | United Kingdom . |
| 624416 | 6/1949 | United Kingdom . |
| 1324456 | 7/1973 | United Kingdom . |
| A2021738 | 12/1979 | United Kingdom . |
| A2124736 | 2/1984 | United Kingdom . |
| A2151753 | 7/1985 | United Kingdom . |
| A2156951 | 10/1985 | United Kingdom . |

*Primary Examiner*—Arnold Rosenthal

*Attorney, Agent, or Firm*—Cushman, Darby & Cushman

[57] ABSTRACT

SA four way slide valve comprises a plunger (122, 51) connected to a slider (113, 45) and a solenoid coil (12, 55) for driving the plunger thereby to switch the four way valve between room-heating and room-cooling, and further, by inserting a demagnetizable permanent magnet (54) in series to magnetic circuit of the plunger (51) and a stator core (52) and magnetizing and demagnetizing the permanent magnet for switching operation of the refrigerant circuit, the hitherto necessitated retention current for the plunger is eliminated, thereby eliminating undesirable noises hitherto generated by a pilot valve used for switching the slide valve, and further saving the power consumption.

6 Claims, 9 Drawing Sheets

SLIDE VALVE

FIELD OF THE INVENTION AND RELATED ART STATEMENT

1. Field of the Invention

The present invention relates to a sliding valve for switching stream by sliding a slider in a valve body, for instance in a four way valve which is to be used, in a heat pump type air conditioner or the like for switching of cooling and warming of a house.

2. Description of the Related Art

A first prior art of four way valve to be used in a heat pump air conditioner is shown, for instance, in the U.S. Pat. No. 2,976,701. The above-mentioned prior art is elucidated with reference to FIG. 1 and FIG. 2, which show cooling state and warming state of the prior art four way valve for the conventional cooling cycle. As shown in the drawings, a compressor 1 and an accumulator 2 are connected through the four way valve 3 to an indoor heat exchanger 4, capillary tube 5 and outdoor heat exchanger 6 in series, to complete a closed circuit of refrigerant. The four way valve 3 comprises a four way valve body 7 having therein two pistons 9, 10, and a separate pilot valve apparatus 8. Inside space of the four way valve body 7 is divided into three valve chambers 11, 12 and 13 by two pistons 9 and 10, and the two pistons 9 and 10 are each other connected by a connection rod 14 so as to slidingly moves at the same time in left-right direction of FIG. 1 with a predetermined gap therebetween, a slide valve 15 is connected to the connection rod 14 so that the slide valve 15 slidingly moves linked with the pistons 9 and 10.

An intermediate space which is defined between the two pistons 9 and 10 has an inlet port 16*a* connected to a pipe 16, outlet port 17*a* connected to a pipe 17, a first connection port 18*a* connected to a pipe 18 and a second connection port 19*a* connected to a pipe 19. Outlet pipe 16 of the compressor 1 is connected through the inlet port to the valve chamber 12 and inlet pipe 17 of the accumulator 2 is connected to the outlet port 17*a* which is always connected to a connection path 21 defined by and formed in the slide valve 15 and a valve seat 20. The first connection port 18*a*, the second connection port 19*a* are connected to each one end of the indoor heat exchanger 4 and outdoor heat exchanger 6, respectively, which are each other connected by their other ends through the capillary tube 5. The pistons 9 and 10 have pressure balance apertures 22 and 23, respectively.

The pilot valve 8 has the following configuration. The pilot valve body has two valve chambers 24 and 25, and a connection hole 29 therebetween is provided at both ends with needle valves 27 and 28 which are driven by a solenoid coil 26. The state of the pilot valve 8 of FIG.1 is the state of cooling the indoor rooms. The state of the pilot valve 8 in FIG. 1 shows that the needle valve 28 closes the connection hole 29. On the contrary, the state of FIG. 2 shows that the connection hole 29 is closed by the other needle valve 27 by electrification of the solenoid coil 26. This state of FIG. 2 is for heating the house. A narrow connection pipe 30 connects the connection hole 29 and the pipe 17. A narrow pipe 31 connects left valve chamber 24 of the pilot valve 8 and the left valve chamber 11 of the main valve body. Similarly a narrow tube connects the right valve chamber 25 of the pilot valve 8 to the right valve chamber of the main valve 3.

The operation of the above-mentioned conventional four way valve for switching the heating and cooling of the heat exchanger is elucidated hereafter. In FIG. 2 which shows a state of heating the indor room, the pressures of divided valve chambers 11, 12, 13, 24 and 25 are as follows. The central valve chamber 12 is in high pressure by means of output gas from the compressor 1 and the left and right valve chambers 11 and 13 are also given pressure through the pressure balance apertures 22 and 23 at that time. However, since the needle valve 27 in the pilot valve 8 is closing the connection hole 29, the pressure of the right valve chamber 13 is released through the narrow tube 32, the valve chamber 25, the connection hole 29 and the narrow tube 30 which is connected to the suction pipe 17; and therefore the pressure of the right valve chamber 13 becomes low pressure. Accordingly, the pressure of the left valve chamber 11 becomes higher than that of the right valve chamber 13, and hence the pistons 9 and 10 are pushed to right side as shown in FIG. 2, thereby operating the heat pump system in room heating operation.

Next, state of the four way valve 3 in the room cooling operation is elucidated with reference to FIG.1. In this state, the solenoid coil 26 is de-energized, thereby restoring the needle valves 27 and 28 to left side by means of restoration spring of the pilot valve 8. Therefore, the needle valve 28 closes the connection hole 29, and the narrow tube 30 is connected to the left valve chamber 14. Accordingly, the left valve chamber 11 of the main valve is connected through the narrow tube 31, the left chamber 24 of the pilot valve 8, the narrow tube 30 to the pipe 17, thereby making the pressure of the left chamber 11 rapidly. Accordingly, the pistons 10 and 9 are pushed leftwards as shown in FIG. 1, thereby connecting a circuit from the compressor through the pipe 16, central chamber 12, pipe 19, outdoor heat exchanger 6, the capillary tube 5, the indoor heat exchanger 4, the tube 18 and tube 17 to the accumulator 2; thereby making the heat pump system in a room cooling state.

In the above-mentioned conventional constitution, in both the room heating operation and room cooling operation, the slide valve 15 is always pressed to the valve seat 20 by pressure difference of the high pressure in the central valve chamber 12 and the low pressure of the outlet pipe 17, and that the pilot valve 8 is necessary to drive the pistons 9 and 10 and the slide valve 15 smoothly when switching from a room heating state to room cooling state of vice versa. Such provision of the pilot valve 8 for driving the main valve 3 necessitates many components, and assembling of the whole apparatus becomes very much complicated. Furthermore, if the narrow tubes 30, 31 and 32 or pressure balancing apertures 20 and 23 or narrow connection hole 29 of the pilot valve are choked by some alien matter, the switching operation becomes unstable, and thus unreliability exists.

Furthermore, in the above-mentioned prior art constitution, since the solenoid coil 26 is continued to be electrified, the power consumption becomes unnecessarily large, thereby hindering power saving. Furthermore, when the room heating operation is stopped by cutting off the electric power, the four way valve is also de-energized, and therefore the needle valves 27 and 28 move leftwards, thereby undesirably switching the main valve to the state of the room heating for a short time, and hence, unnecessary switching noise is produced and uncomfortable cold wind blows out.

There is another prior art wherein pilot valve is omitted is known by the U.S. Pat. No. 3,329,168. The constitution of the second prior art of the above-mentioned U.S. Patent is elucidated hereafter with reference to FIG. 3 and FIG. 4.

FIG. 3 is a sectional elevation view showing the second prior art, and FIG. 4 is a sectional plan view taken by a section plane IV—IV shown in FIG. 3. As shown in FIG. 3 and FIG. 4, a cylinder 101 which constitutes outer case of the valve body comprises a pipe 103 connected to a compressor 102, connection pipes 106 and 107 connected to an indoor heat exchanger 104 and an outdoor heat exchanger 105, respectively. Valve seats 108 and 109 comprises ports 110, 111 and 112 for connection to the pipes 103, 106 and 107, respectively, thus forming sliding faces 108*a* and 109*a*. A drum-shaped slider 113 has slide seat rings 113*a*, 113*a* at the part to contact the seat faces 108*a* and 109*a* of the valve seats 108 and 109, so as to slidably seal a connection path in the slider 113 when it slides in axial direction. Therefore, the port 110 is selectively connected to the ports 111 or 112, thereby to switch the refrigerant path. Bottom lid 114 has a connection port 116 connected to output pipe 115 of the compressor 102. A top lid 117 has a solenoid device 118 fixed thereto for driving the slider 113 in vertical direction. The solenoid device 118 comprises a fixed armature 119, a solenoid coil 120, a restoration spring 121 and a plunger 122, lower end whereof is connected to the upper end of the slider 113. When the solenoid coil 120 is electrified, the slider 113 slides on seat faces 108*a* and 109*a* of the valve seats 108 and 109, thereby to form a predetermined refrigerant circuit.

The operation of the above-mentioned second prior art is as follows: FIG. 3 shows a state where the solenoid coil 120 is not energized, wherein the plunger 122 is pushed down by the restoration spring 121, and the slider 113 stops at its lowest position of stroke abutting to the bottom lid 114. As a result of the lowest positioning of the slider 113, the port 116 and the port 112 are each other connected through gap spaces between the inner walls of the cylinder 101 and periphery of the slider 113. Furthermore, connection port 110 and a connection port 111 are also connected by intermediate space in the drum-shaped slider 113. Therefore, the refrigerant flows in a circuit of compressor 102—connection pipe 115—inlet port 116—outlet port 112—connection pipe 107—outdoor heat exchanger 105—capillary tube 123—indoor heat exchanger 104—connection pipe 106—port 111—outlet port 110—connection pipe 103—and again to the compressor 102 as shown by a solid line arrows; and a predetermined cooling operation is carried out.

Next, in the state where the solenoid coil 120 is energized, which is for a room heating state, the operation is as follows: The slider 113 is held at its upper part of stroke as a result of absorption of the plunger 122 by a fixed core 119, and thereby the port 116 and the port 110 are connected through the gap spaces between the inner walls of the cylinder 101 and the periphery of the slider 113; and furthermore the port 110 and the port 112 are connected through a space defined in the drum-shaped slider 113. Accordingly, the refrigerant flows in a circuit of the compressor 102—pipe 115—port 116—port 111—connection pipe 106—indoor heat exchanger 104—capillary tube 123—outdoor heat exchanger 105—connection pipe 107—port 112—port 110—piped 103—and again to the compressor 102 as shown by dotted arrows, thereby carrying out the predetermined room heating operation.

The above-mentioned prior art construction has the following shortcomings. The valve seats 108 and 109 must be fixed to the inside face of the cylinder 101 by matching and connecting the pipes 103, 106, 107 therethrough, and that, since the positionings of the ports 110, 111 and 112 to the valve seats 108 and 109, respectively must be made by fittings, accurate positioning is difficult and pressure loss or leak of refrigerant through possible gaps at the fitted parts is liable. And further that brazings for cylinder 101 and valve seats 108 and 109 and further between the pipes 103, 106 and 107 must be made at the same time, and such process is not efficient in manufacturing.

Besides, the second prior art also has a solenoid coil 20 which is to be continued energized during the room heating operation, and therefore the system necessitates redandunt power consumption during the room heating operation.

Furthermore, the slide set rings 113*a*, 113*a* are strongly pressed to the valve seat faces 108*a* and 109*a* by the pressure in the cylinder 101, and hence sliding friction becomes large and service lifetime is short.

OBJECT AND SUMMARY OF THE INVENTION

The object of the present invention is to provide a slide valve wherein positioning of valve seats can be made accurately as a result of improved configuration.

Another object of the present invention is to provide an improved slide valve wherein parts to be brazed in manufacturing process can be reduced thereby to improve efficiency of manufacturing.

The above-mentioned objects can be achieved by a slide valve comprising:

a cylinder forming an outer shell of a slide valve by having an inside space which has a pair of each other parallely opposing valve seat faces formed on the inner wall of the inside space in parallelism with the cylinder axis and having at least one outlet port on one valve seat face and at least two connection ports leading the inside space to outside fluid path.

a slider provided slidably in the direction of the cylinder axis along the valve seat faces, and having a fluid connection inside space, for selectively connecting the outlet port to either one of the two connection ports, and a solenoid apparatus for driving the slider in the cylinder axis direction.

In an embodiment of the present invention, by providing a demagnetizable permanent magnet, continued energization of solenoid coil for retaining a state of operation is no more necessary thereby enabling a saving of power source.

In an embodiment of the present invention by providing a special narrow leakage paths around valve seat rings, service lifetime of the slide seat rings can be prolonged.

BRIEF DESCRIPTION OF THE DRAWING

FIG. 1 is for the state of room cooling, and FIG. 2 is for the state of room heating.

DESCRIPTION OF THE PREFERRED EMBODIMENT

Figure 5:
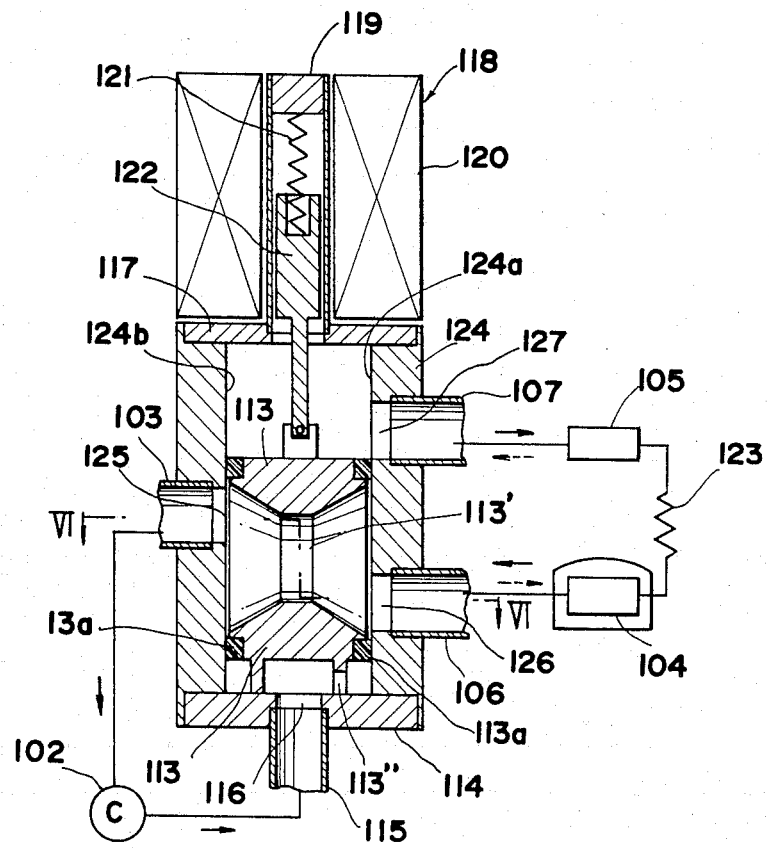
FIG. 5 is a sectional elevation view of a first embodiment of the present invention having a slide four way valve for cooling/heating operation.

Hereafter, a preferred embodiment of the slide valve in accordance with the present invention is elucidated with reference to the drawings of FIG. 5 and thereafter, wherein corresponding parts and components are designated by the same or related numerals.

Figure 6:
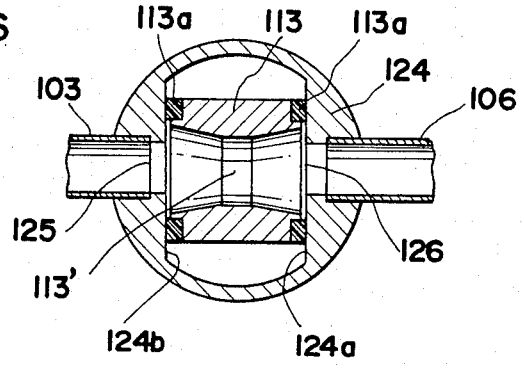
FIG. 6 is a sectional plan view taken at VI—VI sectional plane shown in FIG. 5.

FIG. 5 and FIG. 6 show a first embodiment wherein the slide valve in accordance with the present invention is applied to a four way valve of a cooling/heating system. FIG.5 is a sectional elevation view showing the first embodiment, and FIG. 6 is a sectional plan view taken at VI—VI sectional plane shown in FIG. 5. As shown in FIG. 5 and FIG. 6, a cylinder 124 per se constitutes an outer shell of the valve body, and on the inside walls thereof, each other opposing seat faces **124*a* and 124*b* are formed. The seat faces 124*a* and 124*b* respectively have outlet port 125 and connection ports 126 and 127, to which inlet pipe 103 of a compressor 102 and connection pipes 106 and 107 of an indoor heat exchanger 104 and an outdoor heat exchanger 105 are connected, respectively. A drum-shaped slider 113 is provided in the space inside the clyinder 124 and has slide seat rings 113*a*, 113*a* which slidingly contact the seat faces 124*a* and 124*b*. Therefore the port 125 is selectively connected to the ports 126 or 127, thereby to switch the refrigerant path. A bottom lid 114 has a connection port 116 connected to an output pipe 115 of the compressor 102. A top lid 117 has a solenoid device 118 fixed thereto for driving the slider 113 in vertical direction. The solenoid device 118 comprises a fixed armature 119, a solenoid coil 120, a restoration spring 121 and a plunger 122, lower end whereof is connected to the upper end of slider 113. When the solenoid coil 120 is electrified, the slider 113 slides on the seat faces 124a and 124b of the cylinder 124**, thereby to form a predetermined refrigerant circuit.

The operation of the above-mentioned first embodiment is as follows: FIG. 5 shows a state where the solenoid coil 120 is not energized, wherein the plunger 122 is pushed down by the restoration spring 121, and the slider 113 stops at its lowest position abutting to the bottom lid 114 but leaving a gas flow path 113″ at its bottom. As a result of the lowest positioning of the slider 113, the connection port 116 at the bottom plate 114 and the port 112 are each other connected through gap spaces between the inner walls of the cylinder 101 and periphery of the slider 113. Furthermore, connection port 125 and the connection port 126 are also connected by intermediate space in the drum-shaped slider 113. Therefore, the refrigerant flows in the circuit of compressor 102—connection pipe 115—inlet port 116—outlet port 127—connection pipe 107—outdoor heat exchanger 105—capillary tube 123—indoor heat exchanger 104—connection pipe 106—port 126—outlet port 125—connection pipe 103—and again to the compressor 102 as shown by a solid line arrows; and a predetermined cooling operation is carried out.

Next, in the state where the solenoid coil 120 is energized, which is for a room heating state, the operation is as follows: The slider 113 is held at its upper part of stroke as a result of absorption of the plunger 122 by a fixed core 119, and thereby the port 116 and the the port 125 are connected through the gap spaces between the inner walls of the cylinder 124 and the periphery of the slider 113; and furthermore the port 125 and the port 127 are connected through a space defined in the drum-shaped slider 113. Accordingly the refrigerant flows in a circuit of the compressor 102—pipe 115—port 116—port 126—connection pipe 106—indoor heat exchanger 104—capillary tube 123—outdoor heat exchanger 105—connection pipe 107—port 127—port 125—pipe 103—and again to the compressor 102 as shown by dotted arrows thereby carrying out the predetermined room heating operation.

Figure 1:
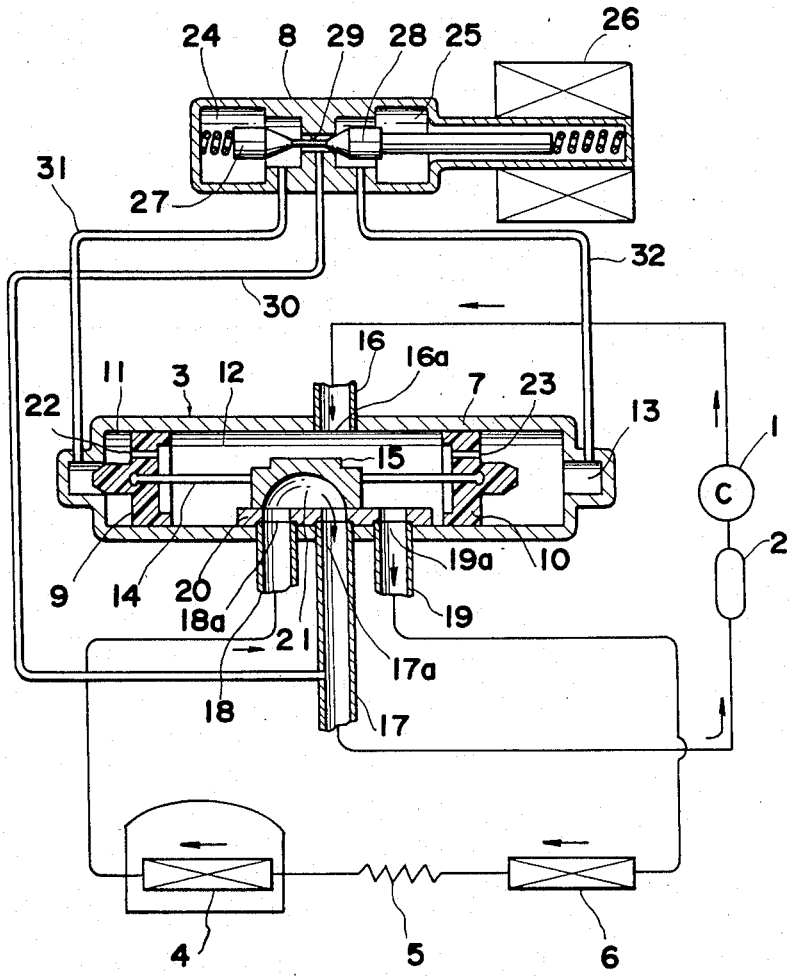
FIG.1 (Prior Art)
FIG. 1 and FIG. 2 are the sectional elevation view with related refrigerant circuit of the first conventional heat pump apparatus having a four way valve. Therein.
Figure 2:
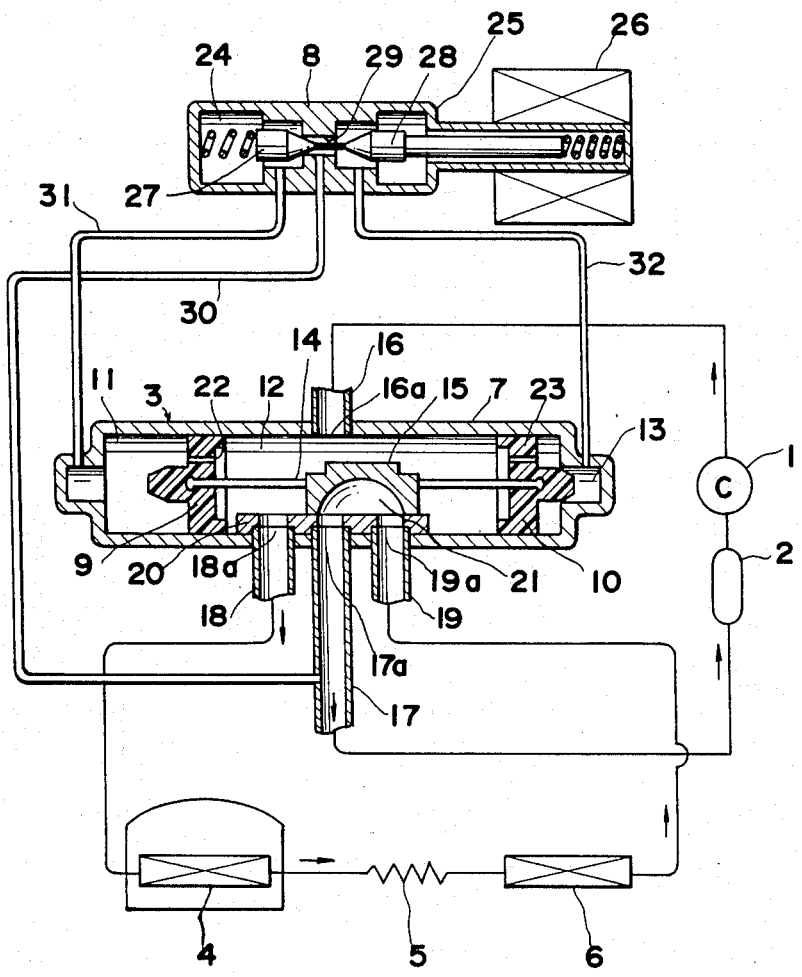
FIG.2 (Prior Art)
Figure 3:
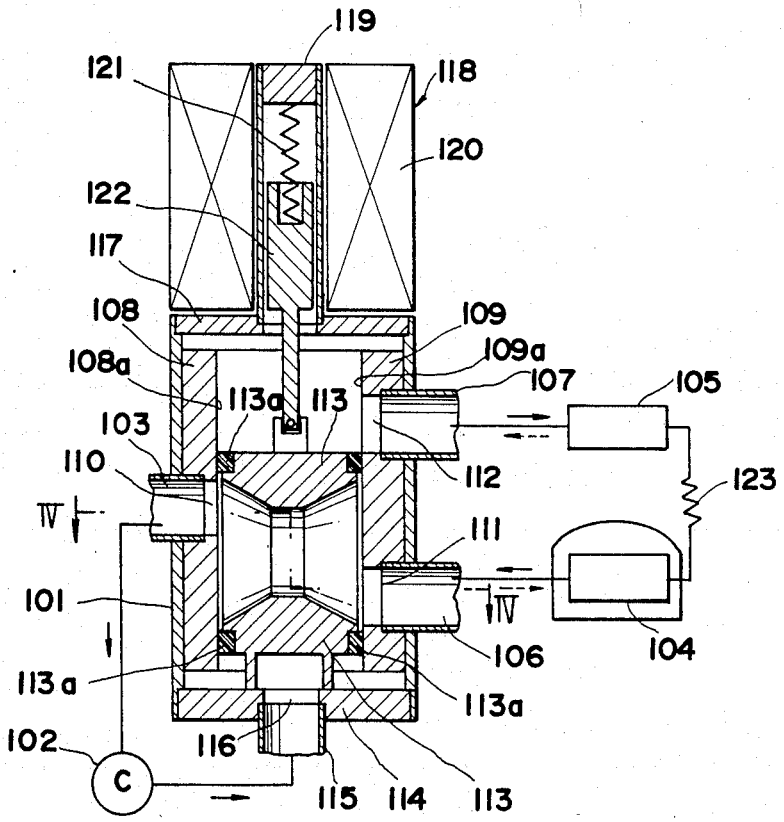
FIG.3 (Prior Art)
FIG. 3 is the sectional elevation view of another heat pump system wherein the refrigerant circuit connection is for a state of room heating.
Figure 4:
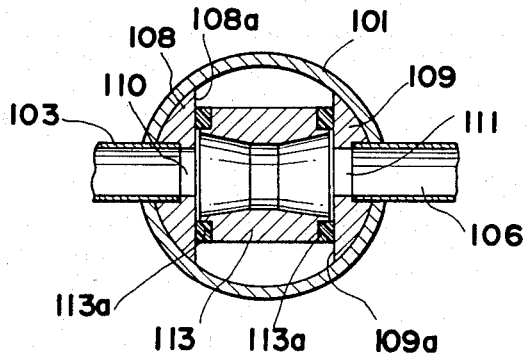
FIG.4 (Prior Art)
FIG. 4 is the sectional plan view taken at IV—IV sectional plane shown in FIG. 3 of the second embodiment.

Next, a second preferred embodiment of the slide value in accordance with the present invention to be used in a four way valve for cooling/heating system is described with reference to FIG. 7, FIG. 8, FIG. 9, FIG. 10, FIG. 11 and FIG. 12. Since the cooling/heating system has the similar constitution to the prior art shown in FIG.1 and FIG. 2, the corresponding parts and components are designated by the same numerals thereto.

Figure 7:
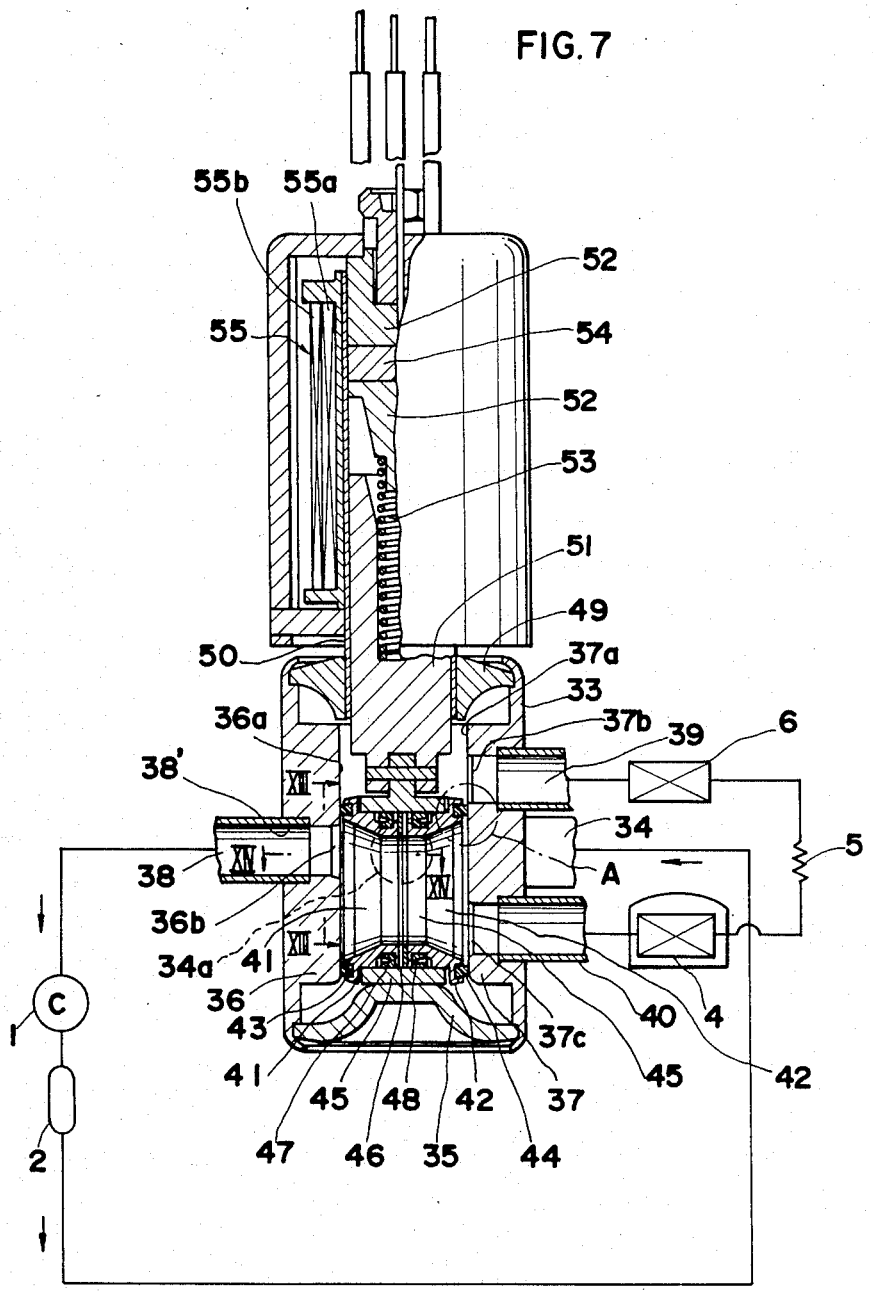
FIG. 7 is a sectional elevation view of a second embodiment of the present invention having a slide four way valve for cooling/heating operation, wherein the four way valve is in the state of a room cooling operation.
Figure 8:
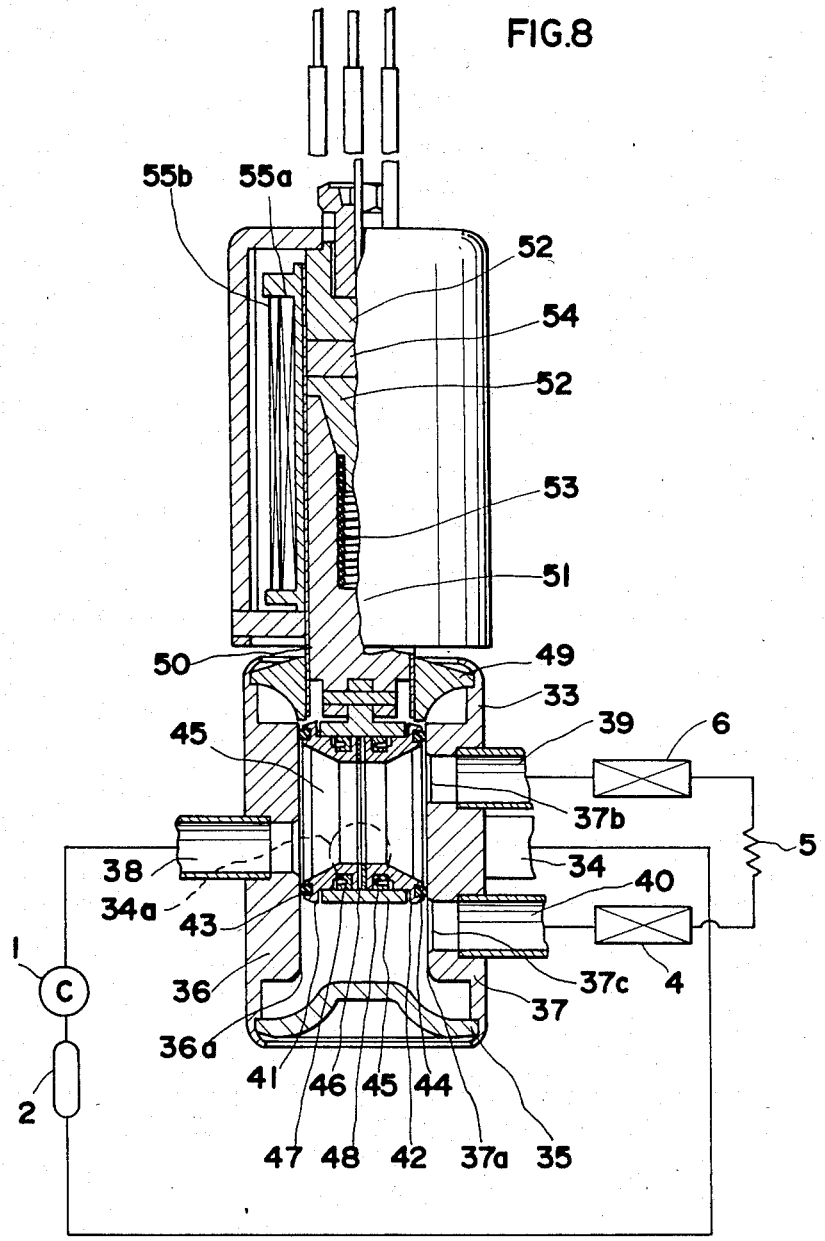
FIG. 8 is a sectional elevation view of the same embodiment as that of FIG. 7 wherein the four way valve is in a state of room heating operation.
Figure 13:
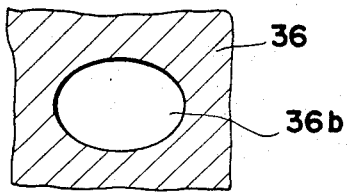
FIG. 13 is an enlarged sectional view taken at XIII—XIII sectional plane shown in FIG. 7.
Figure 14:
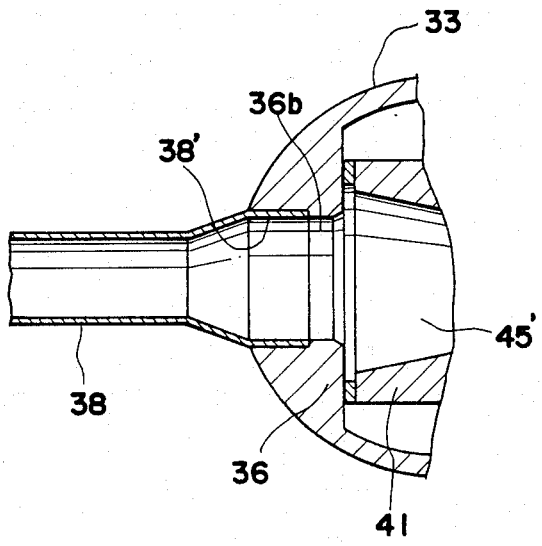
FIG. 14 is an enlarged sectional view taken at XIV—XIV sectional plane shown in FIG. 7.

FIG. 7 and FIG. 8 are sectional elevation views with the related refrigerant circuit in the room cooling state and in the room heating state, respectively. As shown in these figures, a cylinder 33 constituting the valve body has an inlet port **34*a* shown by dotted line and is connected to the output pipe 34 of a compressor 1. A bottom lid 35 is welded to seal the lower end of the cylinder 33. A first valve seat 36 and a second valve seat 37 are provided on the inner wall of the cylinder 33 making their valve seat faces 36*a* and 37*a* parallel with and opposing each other. An outlet port 36*b* to a suction pipe 38 connected to the suction inlet of the compressor is connected to the first valve seat 36. The outlet port 36*b* has a horizontally oblong elliptic section as shown in FIG. 13. And connection end part 38′ of the suction pipe 38 is expanded in horizontal direction so as to have the same elliptic section and inserted in and connected to the outlet port 36*b*. On the second valve seat 37, a first port 37*b* and a second port 37*c* for connecting a first connection pipe 39 and a second connection pipe 40** are provided in the upper part and the lower part, respectively.

Figure 11:
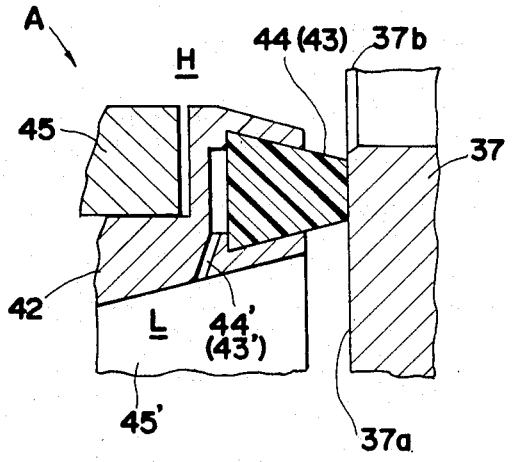
FIG. 11 is an enlarged sectional view of a part A of FIG. 7.
Figure 12:
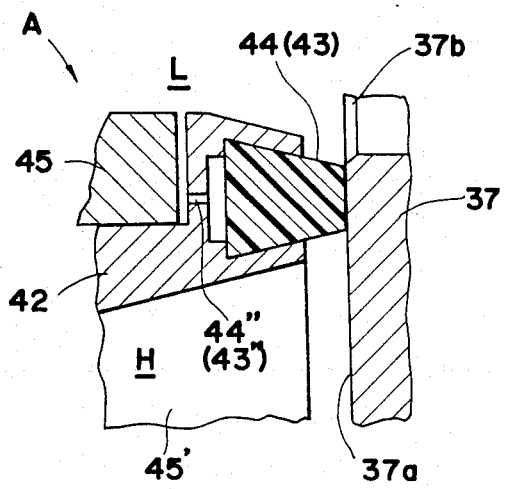
FIG. 12 is a sectional view corresponding to the part shown in FIG. 11 of a still another embodiment.

As shown in FIG. 11 and FIG. 12, paths 43' and 44' or 43" or 44" formed in the slide valves 41 and 42 so as to interconnect low pressure region L and non-contact face of the slide seat rings 43 and 44.

Figure 9:
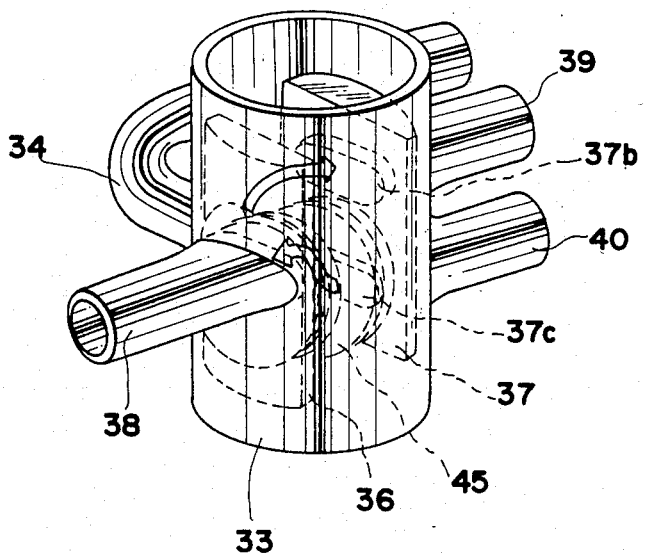
FIG. 9 is a perspective view of a part of the four way valve of the above-mentioned four way valve of the embodiment of FIGS. 7 and 8.

A slider 45 is provided in the cylinder 36, and the slider 45 is formed as shown in FIG. 9 in a short drum shape having its axis in horizontal direction of FIG. 7 thereby forming a connection path P between the ports 38, 34 and 40. The slider 45 comprises a pair of half members 41 and 42 each having slide seat rings 43 and 44 on both ends thereof, respectively, and further has a spring washer 46 at its central gap part between two half members 41 and 42 for energizing the two half members 41 and 42 to be pressed on the valve seat faces **36*a* and 37*a*, respectively. Therefore, the slide seat rings 43 and 44, which are made from a low friction resin, e.g. PTE, hermetically touches the valve seats 36 and 37, thereby constituting the through-hole connection path P in the slider 45. Sealing rings 47 and 48 having V-shaped section are provided to seal the abuttings between the spring washer 46 and the two half members 41 and 42 of the slider 45. A top lid 49 of the cylinder 33 has a pipe 50, which is fixed coaxially thereto penetrating it and contains a plunger 51 therein. A stator core 52 is fixed on the top part of the pipe 50. A restoration spring 53 is mounted between the stator core 52 and the plunger 51 in a manner to push the latter down. An alnico permanent magnet, which is demagnetizable by a reverse magnetization to a previous magnetization, is inserted between an upper part and lower part of the stater core 52. A solenoid coil 55 is provided around and coaxially with the pipe 50, which embraces the stator core 52 and the plunger 53 therein, and consists of an absorption coil 55a and repulsion coil 55*b* (restoration coil) which are wound in opposite direction to each other. When the absorption coil is electrified the permanent megnet 54 is magnetized, thereby absorbing the plunger 51 and retains the magnetization to keep the plunger 51 at the raised position of FIG. 8; and when the repulsion coil is electrified the permanent magnet 54 is demagnetized (namely loses the retained magnetization) thereby lowering the plunger 51 and keeping it at the lower position of FIG. 7. The position and shape of the slide seat rings 43 and 44 are selected such that: when the slider 45 is in the lower position (FIG. 7) resulted fron non-absorption of the plunger 51 by the stator core 52, the outlet port 36*b* and the first port 37*b* are connected each other; and when the slider 45 is in a raised position (FIG. 8) resulted from absorption of the plunger 51 by the stator core, the outlet port 36*b* and the second port 37*c*** are connected each other.

The operation of the above-mentioned second embodiment shown in FIGS. 7–14 is as follows:

ROOM COOLING OPERATION

When the repulsion coil **55*b* is electrified for a predetermined time period, the plunger 51 is repelled to its lower position shown in FIG. 7 and FIG. 9, and the slider 45 stops at its lower position by abutting on the bottom plate 35. Thereafter, by demagnetization of the permanent magnet 54 by the electrification of the repulsion coil 55*b*, the plunger 51 and the slider 45 are retained at its lower position. As a result, by a through-hole space formed by the inside through-hole of the slider 45, the port 36*b* and the lower port 37*c* are interconnected each other, and further the port 34*a* and the upper port 37*b* are also interconnected each other by an upper inner space in the cylinder that is formed by the staying of the slider 45 at the lower position. Accordingly, the refrigerant flows in a cooling cycle path of: the compressor 1—the pipe 34—the upper port 39—the outdoor heat exchanger 6—the capillary tube 5—the indoor heat exchanger 4—lower port 40—the pipe 38—the compressor 1**. Therefore, the room cooling operation is carried out.

ROOM HEATING OPERATION

When the absorption coil **55*a* is electrified for a predetermined time period, the plunger 5*a* is absorbed to its top position shown in FIG. 8, and the slider 45 stops at its upper position abutting the bottom parts of the top lid 49. Thereafter, by magnetization of the permanent magnet 54 by the electrification of the absorption coil 55*a*, the plunger 51 and the slider 45 are retained at its upper position. As a result, by the through-hole space formed by the inside through-hole of the slider 45, the port 36*b* and the higher port 37*b* are interconnected each other, and further the port 34*a* and the lower port 37*c* are also interconnected each other by a lower inner space in the cylinder that is formed by the staying of the slider 45 at the upper position. Accordingly, the refrigerant flows in a heating cycle path of: the compressor 1—the pipe 34—the lower part 40—the indoor heat exchanger 4—the capillary tube 5—the outdoor heat exchanger 6—the upper port 39—the pipe 38—the compressor 1**. Therefore, the room heating operation is carried out.

Figure 10:
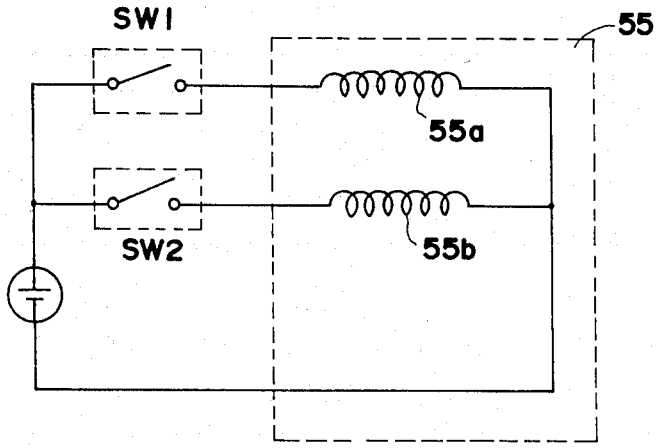
FIG. 10 is an electric circuit diagram of the embodiment of FIG. 5 and FIG. 6.

By the next electrification of the repulsion coil **55*b* for a predetermined time period, by switching on of a switch $SW_2$ of FIG.10, the permanent magnet 54 is again demagnetized, and the plunger 51 is restored to the repelled position by the force of the restoration spring 53**, and the cooling operation is brought again.

A considerably strong froces are liable to push the slide seat rings 43 and 44 out of their mount-grooves towards the valve seat faces **36*a* and 37*a*, respectively, induced by the high pressure difference between the refrigerant gases in thr through-hole space in the slider 45 or the upper or lower inner space in the cylinder 33. Such undesirable pushing out forces to the slide seat rings 43 and 44 are effectively and substantially reduced by an improvement to provide leakage paths 44' or 43' in the slide body 42 as shown in FIG. 11, or leakage paths 44" or 43" as shown in FIG. 12**. By means of such leakage paths, the influence of large difference of the gas pressure is alleviated, and thereby undue strong friction in the sliding motion is also alleviated.

Furthermore, by laterally expanding the connection part of the ports **36*b* to be connected to the inlet pipe 38 of the compressor 1** to a funnel-like shape having an elliptic cross-section, the loss of suction pressure thereat can be decreased. Such expanded funnel-shaped elliptic cross-section connection can be utilized similarly in other parts of the cylinder, for instance, for the outlet port.

The configuration of the embodiments enables operation of the switching of cooling and heating without use of the hitherto-used pilot valve, by directly controlling the slider 113 or 45 by the solenoid coil 120 or 55. Especially in the second embodiment, by utilization of the demagnetizable permanent magnet 54 and the magnetization coil **55*a* and the demagnetization coil 55*b* the retention of the slider 45** in a desired position can be made without need of continuous electrification to the coils for the retention, and hence the driving power is required only for short period of driving the plunger upwards or downwards for the cooling/heating switching. Therefore, the solenoid coil can be made small.

Since the pilot valve is eliminated, the apparatus in accordance with the present invention does not make uncomfortable valve operation noises of the needle valves in the pilot valve at every turning-offs in the heating operation. Especially in the second embodiment, since the plunger 51 is retained at the same position by the function of the magnetic force of the demagnetized permanent magnet 54, there is no motion of the plunger 51 nor the valve slider 45, and hence the thermostat-operated start and stop of the compressor motion is made quietly.

In the improved version of FIG. 11 and FIG. 12, by provisions of the leakage paths 43', 44' or the leakage paths of 43'', 44'', respectively, the sliding frictions of the slide seat rings 43, 44 are reduced and therefore PTFE or the like common resin can be used, and being combined with the advantage of the low loss of the funnel-shaped elliptic section at port **36*b* connected to the compressor 1**, the efficiency of the system is very much improved.

What is claimed is:

1. A slide valve comprising:

a housing for an interior valve chamber provided with flat opposed parallel first and second valve seats;

a first port extending through a wall of said chamber between said seats to the exterior of said housing;

a second port in said first seat extending through a wall of said chamber to the exterior of said housing;

a third and a fourth port in said second seat extending through a wall of said chamber to the exterior of said housing;

a slider movable linearly in said chamber parallel to said seats between two positions and having a through hole for selectively communicating said second port with said third port or said fourth port;

slide members carried by and on opposite sides of said slider and surrounding the ends of said through hole;

spring means urging said slide members in opposite directions against said seats; and solenoid means for selectively moving said slider between said two positions.

2. A four-way valve for a cooling/heating system having a compressor and series-connected outdoor and indoor heat exchangers, comprising:

a housing having an interior valve chamber provided with flat opposed parallel first and second valve seats;

a first port extending through a wall of said chamber between said seats for connection to the outlet of the compressor;

a second part in said first seat extending through a wall of said chamber for connection to the inlet of the compressor;

a third port in said second seat extending through a wall of said chamber for connection to the outdoor heat exchanger;

a fourth port is said seat extending through a wall of said chamber for connection to the indoor heat exchanger;

a slider movable linearly in said chamber parallel to said seats between two positions for selectively communicating said first port with said third or fourth ports, said slider having a through hole for selectively communicating said second port with said third port while said first and fourth ports are in communication or with said fourth port while said first and third ports are in communication;

slide members carried by and on opposite sides of said slider and surrounding the ends of said through hole;

spring means urging slide members in opposite directions against said seats; and solenoid means for selectively moving said slider between said positions.

3. The valve defined in claim 2 wherein each of the slide members is mounted in a groove in the slider and a leakage path is formed is said slider between the bottom of said groove and the hole in said slider.

4. The valve defined in claim 2 wherein each of the slide members is mounted in a groove in the slider and a leakage path is formed in said slider between the bottom of said groove and the valve chamber exteriorly of said slider.

5. The valve defined in claim 2 including a passage section of decreasing cross-sectional area having an elliptic cross-section connected to the exterior of the casing for connecting the second port to the inlet of the compressor to decrease the loss of negative suction pressure at said second port.

6. The valve defined in claim 1 wherein the seats are integrally formed with the housing.

* * * * *